United States Patent [19]

Wendel et al.

[11] 4,397,984

[45] Aug. 9, 1983

[54] USE OF ACRYLATE-BASED EMULSION COPOLYMER AS THE SOLE BINDER FOR A PAPER COATING COMPOSITION

[75] Inventors: Kurt Wendel; Guenther Addicks, both of Ludwigshafen, Fed. Rep. of Germany

[73] Assignee: BASF Aktiengesellschaft, Rheinland-Pfalz, Fed. Rep. of Germany

[21] Appl. No.: 338,487

[22] Filed: Jan. 11, 1982

[30] Foreign Application Priority Data

Feb. 2, 1981 [DE] Fed. Rep. of Germany ..... 3103463

[51] Int. Cl.[3] ..... B05D 3/02; B05D 3/12

[52] U.S. Cl. ..... 524/814; 427/361; 427/387; 427/391; 428/478.8; 428/507; 428/511; 428/514; 524/521; 524/523; 524/524; 524/831; 524/832; 524/833

[58] Field of Search ..... 524/814, 831, 832, 833, 524/521, 523, 524; 428/478.8, 511, 514, 507; 427/361, 387, 391

[56] References Cited

U.S. PATENT DOCUMENTS

| | | | |
|---|---|---|---|
| 2,874,066 | 2/1959 | McLaughlin et al. | 524/446 |
| 3,020,178 | 2/1962 | Sweeney et al. | 427/391 |
| 3,081,198 | 3/1963 | Miller et al. | 524/445 |
| 3,266,971 | 8/1966 | Miller | 427/391 |
| 3,365,410 | 1/1968 | Wesslau et al. | 524/521 |
| 3,873,345 | 3/1975 | Vreeland | 427/391 |
| 4,051,093 | 9/1977 | Wendel et al. | 524/814 |

FOREIGN PATENT DOCUMENTS

| | | |
|---|---|---|
| 2123857 | 10/1971 | Fed. Rep. of Germany . |
| 1092673 | 3/1965 | United Kingdom . |
| 1356030 | 6/1974 | United Kingdom . |

*Primary Examiner*—Ronald W. Griffin

*Attorney, Agent, or Firm*—Oblon, Fisher, Spivak, McClelland & Maier

[57] ABSTRACT

An aqueous paper-coating composition which essentially comprises a finely divided pigment and an emulsion copolymer of (a) from 30 to 80% by weight of $C_4$–$C_8$-alkyl acrylates or mixtures of $C_4$–$C_8$-alkyl acrylates and di-($C_4$–$C_8$-alkyl) maleates, (b) from 8 to 30% by weight of acrylic acid and/or methacrylic acid, (c) from 0 to 50% by weight of vinyl propionate, vinyl acetate, methyl acrylate, ethyl acrylate and/or vinyl $\alpha$-branched $C_{10}$-monocarboxylate, (d) from 0 to 5% by weight of acrylamide, methacrylamide, vinylsulfonic acid, 2-acrylamido-2-methylpropanesulfonic acid and/or acrylonitrile and (e) from 0 to 3% by weight of crosslinking monomers in the form of an aqueous dispersion, as the sole binder and thickener.

7 Claims, No Drawings

USE OF ACRYLATE-BASED EMULSION COPOLYMER AS THE SOLE BINDER FOR A PAPER COATING COMPOSITION

The use of aqueous dispersions of plastics as synthetic binders, conjointly with natural binders such as starch, casein or soybean protein, in paper-coating compositions has been known for a considerable time. However, on high-speed coating machines these compositions often exhibit inadequate shear stability and unsatisfactory compatibility with certain pigments, such as satin white.

U.S. Pat. No. 3,081,198 discloses the use of mixtures of water-insoluble and alkali-insoluble acrylic ester and vinyl ester copolymer dispersions with water-soluble ammonium salts of acrylic acid/acrylic ester copolymers as binders for paper-coating compositions. The pigmented coatings prepared therewith show unsatisfactory gravure printability, manifesting itself in that the gravure ink in particular is insufficiently uniformly transferred to the coating in the half-tone areas, and thereby produces faults, referred to as missing dots, in the print.

German Pat. No. 1,258,721 discloses binder mixtures, based on aqueous dispersions, for neutral or alkaline paper-coating compositions. These mixtures comprise an emulsion copolymer A, which contains from 40 to 70 parts by weight of styrene and from 30 to 60 parts by weight of an ester of acrylic acid or methacrylic acid with an alcohol of 2 to 12 carbon atoms, with or without up to 10 parts of other ethylenically unsaturated copolymerizable compounds, and an emulsion copolymer B of from 15 to 55% by weight of acrylic acid and/or methacrylic acid, with or without up to 10% by weight of acrylamide and/or methacrylamide, and from 85 to 45% by weight of other water-insoluble homopolymerizable monomers, of which hydrophobic monomers not less than 20% by weight consist of esters of acrylic acid or methacrylic acid with alcohols of 1 to 4 carbon atoms. The binder mixture contains from 5 to 40 parts by weight of one or more copolymers B and from 95 to 60 parts by weight of one or more copolymers A. The paper-coating compositions prepared using these binder mixtures do admittedly conform to processing requirements, but no longer meet the ever-higher requirements in respect of printability of the coated papers in magazine gravure printing.

German Published Application DAS No. 1,100,450 discloses a coating composition for the production of art printing paper, which contains, per 100 parts by weight of a pigment, from 8 to 25 parts by weight of a water-insoluble copolymer consisting of one or more alkyl acrylates and from 2.5 to 7% by weight of one or more amide, for example of methacrylic acid or acrylic acid, or from 8 to 25 parts by weight of a salt of a water-insoluble copolymer consisting of one or more alkyl acrylates and from 2.5 to 7% by weight of an ethylenically unsaturated carboxylic acid, eg. itaconic acid, aconitic acid, maleic acid, fumaric acid, dimeric methacrylic acid or trimeric methacrylic acid, as the sole binder. According to this Published Patent, copolymers which contain 4–5% by weight, or more, of acrylic acid or methacrylic acid as copolymerized units excessively increase the viscosity of alkaline paper-coating compositions, so that they cannot be employed as sole binders for this purpose.

It is an object of the present invention to provide a binder for paper-coating compositions which can be used as a sole binder and at the same time imparts to the paper-coating composition sufficiently high viscosity and water retention, so that the conventional additives for increasing the viscosity and water retention of paper-coating compositions can be dispensed with.

We have found that this object is achieved by the use of an emulsion copolymer of (a) from 30 to 80% by weight of $C_4$–$C_8$-alkyl acrylates or mixtures of $C_4$–$C_8$-alkyl acrylates and di-($C_4$–$C_8$-alkyl)maleates, (b) from 8 to 30% by weight of acrylic acid and/or methacrylic acid, (c) from 0 to 50% by weight of vinyl propionate, vinyl acetate, methyl acrylate, ethyl acrylate and/or vinyl $\alpha$-branched $C_{10}$-monocarboxylate, (d) from 0 to 5% by weight of acrylamide, methacrylamide, vinylsulfonic acid, 2-acrylamido-2-methylpropanesulfonic acid and/or acrylonitrile and (e) from 0 to 3% by weight of crosslinking monomers in the form of an aqueous dispersion, as the sole binder and thickener for a paper-coating composition.

The emulsion copolymers are prepared by conventional processes. The essential constituents of these copolymers are $C_4$–$C_8$-alkyl acrylates, eg. n-butyl acrylate, isobutyl acrylate, pentyl acrylate, n-hexyl acrylate and 2-ethylhexyl acrylate, and mixtures of such acrylates with minor amounts of di-($C_4$–$C_8$-alkyl)maleates, eg. di-n-butyl maleate, di-isobutyl maleate and di-2-ethylhexyl maleate. The maleates are used as a partial replacement for the relevant acrylates and may be present in up to 20% by weight in the monomer mixture (a). Preferably, the acrylates and maleates are derived from monohydric primary or secondary $C_4$–$C_8$-alcohols. The monomers of group (a) are present in the copolymer either as individual compounds or as mixtures. For example, it is possible to use a mixture of n-butyl acrylate and 2-ethylhexyl acrylate or of n-butyl acrylate and di-n-butyl maleate. The emulsion copolymer contains from 30 to 80, preferably from 35 to 50, % by weight of the monomers of group (a) as copolymerized units.

As a second essential component, the emulsion copolymer contains the monomers of group (b), namely acrylic acid or methacrylic acid or a mixture of these. The copolymer contains from 8 to 30, preferably from 12 to 20, % by weight of these two ethylenically unsaturated carboxylic acids as copolymerized units.

In addition to the above two groups of monomers, the emulsion copolymers may be modified by also containing, as copolymerized units, vinyl propionate, vinyl acetate, methyl acrylate and/or ethyl acrylate and/or $\alpha$-branched vinyl $C_{10}$-monocarboxylates as monomers of group (c). These monomers account for at most 50% by weight of the copolymer.

Equally, the monomers of group (d) are used only as an optional component, where it is desired to modify the properties of the emulsion copolymer in a certain way. Group (d) mostly comprises water-soluble monomers, such as acrylamide, methacrylamide, vinylsulfonic acid, 2-acrylamido-2-methylpropanesulfonic acid and/or acrylonitrile. These monomers, again, can be employed either individually or as mixtures in the emulsion copolymerization, and they can account for up to 5% by weight of the copolymer.

The properties of the emulsion copolymers can furthermore be modified by carrying out the emulsion polymerization in the presence of up to 3% by weight, based on the monomer mixture, of crosslinking monomers (monomers of group (e). Examples of such monomers are methylene-bis-acrylamides, methylene-bis-methacrylamides, diacrylates, polyacrylates, dimethacrylates and polymethacrylates of dihydric or polyhydric $C_2$–$C_6$-alcohols, divinyldioxane, diallyl phthalate, diallyl ethers or triallyl ethers of dihydric or polyhydric alcohols, especially of pentaerythritol, and diacrylates and dimethacrylates of polyethylene glycols and polypropylene glycols.

Normally, the first stage in the polymerization of the monomers is to prepare an aqueous emulsion of the monomers. Preferably, the monomers are mixed and emulsified in water using an emulsifier, examples of suitable materials being the alkali metal salts and ammonium salts of n-dodecylsulfonic acid and dodecylbenzenesulfonic acid and the corresponding salts of the sulfuric acid half-esters of long-chain alcohols having an even number of carbon atoms, or of the half-esters obtained by reacting higher fatty alcohols with from 2 to 25 moles of ethylene oxide and then reacting the oxyethylated alcohol with sulfuric acid. Other suitable emulsifiers include adducts of alkylphenols, for example para-iso-octylphenol, with from 5 to 25 moles of ethylene oxide, and their sulfuric acid half-esters in the form of the Na or K salts. The corresponding salts of sulfosuccinic acid are also suitable emulsifiers. As a rule, the emulsifiers are employed in amounts of from 0.5 to 5% by weight, based on the monomers to be polymerized.

Where necessary, the dispersion can be prepared by the monomer feed process, in which case pre-emulsification is omitted.

Suitable polymerization initiators are conventional free radical-forming compounds, such as peroxides, persulfates, hydroperoxides and azo compounds, examples being potassium persulfate, cumene hydroperoxide and hydrogen peroxide. The polymerization can also be initiated with redox catalysts or with activated initiator systems, for example with a system of potassium persulfate and ascorbic acid or of sodium hydroxymethanesulfonate or triethanolamine. The polymerization temperature lies within the conventional range, for example from 70° to 95° C., but can also be lower if a redex catalyst is employed. Polymerization can also be carried out at higher temperatures and under pressure. To regulate the molecular weight of the polymers, the conventional chain transfer agents can be used in the polymerization, examples being dodecylmercaptan and halohydrocarbons, eg. chloroform, carbon tetrachloride and tetrachloroethylene.

In this way, stable copolymer dispersions of concentration from 20 to 50% by weight are obtained. Preferably, polymer dispersions having a high polymer concentration are prepared.

Suitable pigments for the paper-coating compositions are the conventional finely divided pigments employed for this purpose, for example the various types of clay, chalk, satin white and titanium dioxide. The paper-coating compositions used to prepare gravure printing papers contain, per 100 parts by weight of a finely divided pigment, from 4 to 7, preferably from 4.2 to 5.5, parts by weight of one of the above emulsion copolymers or of a mixture of the appropriate emulsion copolymers. They can moreover contain conventional additives, for example from 0.05 to 3% by weight of a dispersant based on low molecular weight acrylic acid polymers (K value of the polymer from 10 to 25 ), optical brighteners and conventional assistants, eg. stearates, tinting dyes, anti-foam agents, bases etc. The pH of the finished paper-coating composition is as a rule from 6.5 to 10, preferably from 8 to 9.5. To prepare papers intended for offset printing, from about 10 to 20 parts by weight of the above emulsion copolymer is used per 100 parts by weight of a finely divided pigment. The emulsion copolymers which can be thickened with alkali can also be used as sole binders in paper-coating compositions used for the preparation of papers to be printed by letterpress printing or flexographic printing.

The emulsion copolymers to be used according to the invention are employed as sole alkali-thickenable binders (examples of suitable alkalis being sodium hydroxide solution, potassium hydroxide solution, ammonia and amines) in paper-coating compositions, and make it unnecessary to employ other additives, such as thickeners, natural binders or other synthetic binders. This simplifies the formulation of the coating composition. Moreover, even when using only a small amount of the copolymer as the binder in the coating composition, the papers obtained exhibit excellent gravure printing characteristics, without dusting of the pigmented coating. The gravure printing characteristics of these papers are better than those of papers prepared using different binders or binder mixtures. The improved quality of the gravure print obtained is assessed in terms of the missing dots.

The finished paper-coating composition can be applied to base paper by all conventional methods. Because of the high shear stability of the emulsion copolymers, the paper-coating compositions can be used on high speed roll-coaters or knife coaters. Preferably, an unsized base paper is coated, but pigment coatings can also be applied to papers which have been engine-sized or surface-sized.

In the Examples which follow, parts and percentages are by weight. The K values are determined by the method of H. Fikentscher, Cellulose-Chemie 13 (1932), 58–64 and 71–74, in 0.5% strength dimethylformamide solution at 20° C.; $K=k.10^3$.

Preparation of aqueous dispersions of emulsion copolymers

EMULSION COPOLYMER I

The polymerization apparatus used was a 2 liter four-necked flask equipped with a stirrer, thermometer, reflux condenser and two feed vessels. Feed vessel I contained an aqueous emulsion of 560 parts of n-butyl acrylate, 70 parts of methacrylic acid, 70 parts of acrylic acid and 270 parts of water; the emulsion was prepared by mixing these components in the presence of 25 parts of a 28% strength aqueous solution of the sodium salt of a sulfated adduct of a straight-chain $C_{12}/C_{14}$-alcohol (coconut alcohol) with 2.5 moles of ethylene oxide, as the emulsifier. The second feed vessel contained a solution of 1.05 parts of potassium peroxodisulfate in 150 parts of water (feed II).

270 parts of water, 30 parts of feed I and 15 parts of feed II were introduced into the reaction flask and the contents were heated to 75° C., with stirring. After an initial polymerization time of 15 minutes, the addition of feeds I and II was started, feed I being run is over 80 minutes and feed II over 90 minutes, at a polymerization temperature of 75° C. After completion of the addition of monomer and catalyst, the reaction mixture was kept for 2 hours at 75° C. and was then cooled and filtered. A 49.9% strength dispersion of a copolymer of 80% of n-butyl acrylate, 10% of methacrylic acid and 10% of acrylic acid was obtained.

EMULSION COPOLYMER II

A copolymer of 35% of n-butyl acrylate, 15% of acrylic acid, 35% of ethylhexyl acrylates and 15% of vinyl acetate was prepared in the polymerization apparatus described above. First, a feed I was prepared, consisting of an emulsion of 245 parts of n-butyl acrylate, 245 parts of 2-ethylhexyl acrylate, 105 parts of vinyl acetate, 105 parts of acrylic acid, 235 parts of water and 140 parts of a 20% strength solution of the sodium salt of a sulfated adduct of isooctylphenol with 25 moles of ethylene oxide. Feed II was a solution of 3.5 parts of potassium peroxodisulfate in 150 parts of water.

234 parts of water, 54 parts of feed I and 15 parts of feed II were introduced into the reaction vessel and heated to 85° C. After an initial polymerization time of 15 minutes at 85° C., the addition of feeds I and II was started, feed I being added continuously over 105 minutes and feed II over 120 minutes. During the polymerization, the internal temperature was 85° C., and this was maintained for 2 hours after completion of the addition of monomer and initiator. The reaction mixture was then cooled and filtered through a sieve. A 48.5% strength aqueous dispersion was obtained.

EMULSION COPOLYMER III

A further emulsion copolymer is prepared in the above apparatus, using as feed I an emulsion obtained by emulsifying 364 parts of n-butyl acrylate, 175 parts of vinyl propionate, 70 parts of vinyl acetate and 91 parts of acrylic acid in 267 parts of water with 140 parts of a 20% strength solution of the sodium salt of a sulfated adduct of isooctylphenol with 25 moles of ethylene oxide. Feed II was a solution of 3.5 parts of potassium peroxodisulfate in 150 parts of water. Additionally, a feed III was used, consisting of a solution of 0.7 part of ascorbic acid and 0.014 part of iron (II) ammonium sulfate in 100 parts of water.

266 parts of water, 33 parts of feed I, 15 parts of feed II and 10 parts of feed III were mixed at room temperature in the polymerization vessel, a stream of nitrogen being passed through the mixture. The contents of the flask were then heated to 60° C., with thorough mixing. After having kept the mixture for about 15 minutes at 60° C., the contents of the 3 feed vessels were run into the reaction mixture in the course of one hour 45 minutes, and after completion of the monomer and initiator addition, the mixture was kept at 60° C. for a further 1½ hours. It was then cooled and filtered. The polymer dispersion obtained had a solids content of 43.7% and a pH of 2.1.

EXAMPLE 1a 2,000 g of a coating clay (Clay SPS) were introduced into 1,000 g of water in which were dissolved 6 g of sodium polyacrylate of K value 19 and 2 g of sodium hydroxide, the mixture being exposed to high shearing forces and dispersed for 20 minutes. 180 g of a 50% strength dispersion of emulsion copolymer I (=4.5 parts of dry polymeric binder per 100 parts of pigment) were then introduced, with stirring, into the pigment suspension, the polymer constituting the alkali-thickenable binder. The coating composition was then brought to pH 9 with 20% strength aqueous sodium hydroxide solution and adjusted to a solids content of 53% with water at pH 9, this mixture had a viscosity of 1,100 mPa.s (in a Brookfield viscometer at 100 rpm) and a water retention value of 32 sec. This retention capacity is the time in which the aqueous phase of the coating composition. stained with an acid red dye, has penetrated sufficiently through a filter paper that it has reduced the reflectance of the latter, measured by means of a reflectance photometer (filter 4), to 40% of the original reflectance.

The coating composition was applied by means of a knife coater to a ligneous coating base paper, at a speed of 40 m/min, the coating weight being 11 g/m$^2$ per side. After glazing in a laboratory calender, the paper had a dry pick resistance of 73 cm/sec (measured by the IGT method).

A print applied by means of a Haindl laboratory gravure printer had fewer then 10 missing dots over a half-tone area of 30 cm$^2$, the missing dots being counted visually.

EXAMPLE 1b

Emulsion polymer I was employed in an increased amount of 440 g of the dispersion of about 50% strength (=11 parts of dry polymer binder per 100 parts of pigment), as the alkali-thickenable binder, together with 2,000 g of coating clay (Euroclay K). At a solids content of 50%, the coating composition had a viscosity of 1,160 mPa.s (in a Brookfield viscometer at 100 rpm) and a water retention value of 64 sec. After drying and glazing, the coating had a dry pick resistance (measured by the IGT method) of 157 cm/sec and a wet pick resistance of 47% (densitometer reading of the moist coating, picked by the IGT method, in percent of the densitometer reading of the full tone), and accordingly has excellent characteristics for offset printing.

EXAMPLE 2a

A coating composition prepared by the method of Example 1a, but employing emulsion polymer II (4.5 parts of dry weight per 100 parts of clay) as the alkali-thickenable sole binder, had a solids content of 56% and, at pH 9, a viscosity of 1,100 mPa.s (at 100 rpm in a Brookfield viscometer). The water retention value was 17 sec. The composition was coated onto the ligneous coating base paper as in Example 1a. After drying and glazing, a value of 51 cm/sec was measured for the dry pick resistance by the IGT method. When gravure-printed, fewer than 10 missing dots were found over a half-tone area of 30 cm$^2$.

EXAMPLE 2b

A coating composition prepared similarly to Example 1b, with emulsion polymer II, had a solids content of 56%, a pH of 8.6, a viscosity of 1,080 mPa.s and a water retention value of 45 sec. The paper, coated as described above and then glazed, had a dry pick resistance of 126 cm/sec and a wet pick resistance of 27%. Accordingly, the properties were of the order of those of conventional offset printing papers.

EXAMPLE 3a

Example 1a was repeated, except that in place of the binder described there, an equal amount (dry weight) of the emulsion copolymer III was employed, in the form of the 43.7% strength aqueous dispersion, as the sole, alkali-thickenable, binder. The paper coating composition obtained had a solids content of 56% and a viscosity, at a pH of 8.6, of 1,800 mPa.s; the water retention value was found to be 24 sec. The composition was coated onto the ligneous coating base paper as in Example 1, and was dried. A test of the pick resistance of the glazed paper, by the IGT method, gave a value of 44 cm/sec. Fewer than 10 missing dots were found over a half-tone area of 30 $cm^2$ of the gravure-printed paper.

EXAMPLE 3b

Emulsion polymer III, when employed in the same manner and the same amount as in Example 1b, gave a coating composition having a solids content of 50%, a viscosity of 1,400 mPa.s and a water retention value of 63 sec. The dry pick resistance determined by the IGT method of 112 cm/sec and the wet pick resistance was 23%. Accordingly, these values are of the same order as those of conventional offset papers.

COMPARATIVE EXAMPLE 1a (GRAVURE PRINT)

The paper coating composition was prepared as described in Example 1a, except that the binder used consisted of 6 parts (dry weight), per 100 parts of pigment, of a binder mixture according to Example 2 of German Pat. No. 1,264,945, namely a mixture of 70 parts of a 50% strength dispersion of a copolymer of 55 parts of butyl acrylate, 45 parts of vinyl acetate and 2 parts of acrylic acid, and 30 parts of a 30% strength dispersion of a copolymer of 112.5 parts of ethyl acrylate, 30 parts of acrylic acid and 7.5 parts of acrylamide. The coating composition had a solids content of 51%, a viscosity of 1,060 mPa.s and a water retention value of 43 sec. A paper coated with this composition by the method described in Example 1, and then glazed, had a dry pick resistance of 36 cm/sec and, when gravure printed, showed 15–20 missing dots over a half-tone area of 30 $cm^2$.

A further coating composition, containing only 4.5 parts (dry weight) of the binder per 100 parts of pigment, ie. the same amount of binder as in Examples 1a to 3a, gave a coating which, because of inadequate bonding, produced deposits on the calender.

COMPARATIVE EXAMPLE 1b

The binder mixture of Example 2 of German Patent 1,264,945, employed for comparison, when used in an amount of 11 parts (dry weight) per 100 parts of pigment in the coating composition described in Example 1b, gave a wet pick resistance of 12%. Accordingly, the strength of the coating was below that of comparable offset papers, which have a dry pick resistance of greater than 100 cm/sec and a wet pick resistance of greater than 20%.

We claim:

1. A process for preparing a coated paper product, comprising:

coating a paper substrate with a composition of a finely divided pigment and a synthetic binder, the sole binder and thickener components of the composition being an emulsion copolymer of (a) from 30 to 80% by weight of at least one $C_4$–$C_8$ alkyl acrylate or a mixture of at least one $C_4$–$C_8$ alkyl acrylate and at least one di-($C_4$–$C_8$-alkyl)maleate; (b) from 8 to 30% by weight of acrylic acid and/or methacrylic acid; (c) from 0 to 50% by weight of vinyl propionate, vinyl acetate, methyl acrylate; ethyl acrylate and/or vinyl $\alpha$-branched $C_{10}$-monocarboxylate; (d) from 0 to 5% by weight of acrylamide, methacrylamide, vinylsulfonic acid, 2-acrylamido-2-methylpropanesulfonic acid and/or acrylonitrile and (e) from 0 to 3% by weight of a crosslinking monomer in the form of an aqueous dispersion.

2. The process of claim 1, wherein said emulsion copolymer comprises (a) from 30 to 80% by weight of n-butyl acrylate, (b) from 8 to 30% by weight of acrylic acid and (c) up to 50% by weight of vinyl propionate and/or vinyl acetate.

3. The process of claim 1, wherein said paper coating composition contains from four to six parts by weight of said emulsion copolymer per hundred parts by weight of a finely divided pigment with the coated paper product obtained being intended for use in gravure printing.

4. The process of claim 1, wherein said coating composition contains from 10 to 20 parts by weight of said emulsion copolymer in 100 parts by weight of a finely divided pigment, the coated paper product obtained being intended for use in offset printing.

5. The process of claim 1, wherein said crosslinking monomer is a methylene-bis-acrylamide, a methylene-bis-methacrylamide, a diacrylate, a polyacrylate, a dimethacrylate or a polymethacrylate of a dihydric or polyhydric $C_2$–$C_6$-alcohol, divinyldioxane, diallylphthalate, a diallyl ether or triallyl ether of a dihydric or polyhydric alcohol or a diacrylate or dimethacrylate of polyethylene glycol or polypropylene glycol.

6. The process of claim 1, wherein said $C_4$–$C_8$ alkyl acrylate is n-butyl acrylate, isobutyl acrylate, pentyl acrylate, n-hexyl acrylate or 2-ethylhexyl acrylate.

7. The process of claim 1, wherein said di-($C_4$–$C_8$ alkyl)maleate is di-n-butyl maleate, di-isobutyl maleate or di-2-ethylhexyl maleate.

* * * * *